US008511647B1

(12) United States Patent
Winningham et al.

(10) Patent No.: US 8,511,647 B1
(45) Date of Patent: Aug. 20, 2013

(54) TWO-PART, MAGNETICALLY-SECURED RIGGING AND CLIMBING BLOCKS

(75) Inventors: Scott Winningham, Algood, TN (US); Scott Prophett, Loganville, GA (US); James Pennefeather, Binghamton, NY (US); James J. Rullo, Binghamton, NY (US); DeForest C. Canfield, Oxford, NY (US)

(73) Assignee: Buckingham Manufacturing Company, Inc., Binghamton, NY (US)

( * ) Notice: Subject to any disclaimer, the term of this patent is extended or adjusted under 35 U.S.C. 154(b) by 0 days.

(21) Appl. No.: 12/617,134

(22) Filed: Nov. 12, 2009

Related U.S. Application Data

(60) Provisional application No. 61/113,758, filed on Nov. 12, 2008.

(51) Int. Cl.
*B65D 3/04* (2006.01)

(52) U.S. Cl.
USPC ..... 254/405; 254/393

(58) Field of Classification Search
USPC ..... 254/393, 397, 402, 405, 406; 182/6, 182/7; 24/303; 248/74
See application file for complete search history.

(56) References Cited

U.S. PATENT DOCUMENTS

| | | | | | |
|---|---|---|---|---|---|
| 647,924 | A | * | 4/1900 | Kennedy | 254/405 |
| 5,660,113 | A | * | 8/1997 | Lehotsky | 104/113 |
| 5,699,991 | A | * | 12/1997 | Melinyshyn | 248/332 |
| 5,785,146 | A | * | 7/1998 | Palmer | 182/3 |

* cited by examiner

*Primary Examiner* — Michael Mansen
*Assistant Examiner* — Nathaniel Adams
(74) *Attorney, Agent, or Firm* — Mark Levy; David L. Banner; Hinman, Howard & Kattell, LLP

(57) ABSTRACT

Climbing or rigging block having two portions held together by magnetic attraction. The climbing or rigging blocks may be installed or retrieved from the ground using only a throw line, a throw bag, and a retrieval ball. When in position, magnetic attraction between the two component blocks forms a single unit. The block sets may be provided in several sizes having different supporting capacities.

7 Claims, 7 Drawing Sheets

TWO-PART, MAGNETICALLY-SECURED RIGGING AND CLIMBING BLOCKS

RELATED APPLICATIONS

This application is a Continuation-in-Part of U.S. Provisional Patent Application Ser. No. 61/113,758 filed Nov. 12, 2008 and claims priority thereto in accordance with 35 U.S.C. §1.78.

BACKGROUND OF THE INVENTION

1. Field of the Invention

The invention pertains to rigging and climbing blocks and, more particularly, to two-part, magnetically-secured climbing and rigging blocks installable and removable from the ground.

2. Discussion of the Related Art

Numerous climbing devices, systems, and methods of support are presently available to the arborist engaged in the care and maintenance of trees. As used hereinafter, the term "arborist" is intended to include any workman working in an elevated position wherein a climbing or rigging block is useful in pursuit of their work. An arborist will employ an aerial lift device or use climbing techniques when working in an elevated position. Climbing techniques involve using one or more climbing ropes in combination with a climbing harness. Aerial lift devices range from large, truck-mounted, systems employing buckets disposed at the end of hydraulic-powered, multi-axis articulating boom to smaller units capable of being towed by small vehicles, a.k.a. "pull behind" models.

Selection of the method and apparatus to be used in a particular application depends on a number of factors including height, location and accessibility of the job site (i.e., tree, foliage and branch density proximate the regions of interest), as well as the nature and amount of work to be performed. For example, an aerial lift may be desirable for use in the removal of a large number of branches from curbside trees which threaten electrical power lines or the like passing nearby; whereas, climbing techniques may be advantageously employed to trim deadwood from an exotic tree species located in a private garden which is otherwise inaccessible by an aerial lift.

Tree crotches, the V-shaped junctions between two limbs or between a limb and the main stem or trunk of a tree, are routinely used to support a climbing or rigging line rope. In one technique, a length of rope is disposed in the crotch and fixedly attached to a climbing harness at one end thereof. The free portion of the rope is attached to the harness with a friction knot, after being passed around the limb or stem. Such a scheme is advantageous in that the arborist may work efficiently in several areas by moving relatively freely about a limited region of the tree through adjustment of the rope loop length supported in the crotch. But such movement routinely results in significant abrasion damage to the bark and often damages the underlying cambium layer of the tree necessary for secondary growth. Such techniques also accelerate climbing rope abrasion and wear, necessitating replacement of the costly rope.

Additional pads of leather or other sacrificial material may be attached to the tree in an attempt to protect both the tree and rope; however, such devices are difficult to employ effectively, due to the tendency of the climbing rope to slip off the pad during use due to changes in orientation and attitude of the arborist relative to the support location. Such devices are also typically unwieldy and bulky, requiring proximate positioning of the arborist for proper manual installation and retrieval.

Protection of the tree from direct abrasion due to movement of the climbing rope may also be effected by the use of lifting slings, similar in configuration to those typically employed in the movement of cargo by cranes or other lifting devices. For example, a continuous loop of rope or webbing may be employed in a conventional choker hitch configuration in a tree crotch or around a tree limb. A climbing rope may pass through the free end loop formed therein to support the arborist as discussed hereinabove. While generally reducing bark abrasion, such a configuration can damage the tree if the load being supported exceeds the capability of the limb, if the constriction of the limb becomes too great, or if the sling slips and moves while under load.

An additional problem with the use of a conventional loop sling in combination with a climbing rope is the problem of installation and removal of the sling in the tree. Conventional methods of ascending the tree, including the use of ladders, climbing spikes or solely ropes which abrade the bark, must often be employed to permit the arborist to reach a suitable location for installation of the sling. Generally, a relatively high altitude location is chosen to afford advantageous support for one or more targeted work regions. Once there, the arborist installs the sling on the limb and couples the climbing rope thereto, at which point the arborist may safely descend and begin work. Since the arborist may be some distance from the original support location after completing work in one region of the tree, a second sling may have to be employed to establish a second suitable support location for completing additional work in another region of the tree. In this manner, numerous slings may be required to adequately perform the desired maintenance on the tree.

In addition to the weight and bulk of the slings which must be carried by the arborist, retrieval thereof is problematic, requiring either individually revisiting the support locations to manually remove the slings or attempting to remove them remotely, for example by pulling on separate ropes attached to the slings themselves. Remote retrieval may be frustrated by catching, snagging or wedging of the loop sling in a tree crotch or on a branch, ultimately necessitating manual removal of the sling. The additional retrieval ropes may also become entangled with the climbing rope, arboreal equipment or other portions of the tree. Further, uncontrolled remote retrieval poses a potential safety hazard both to the arborist and to others working in the vicinity due to the free-falling sling, as well as to the tree which may be damaged if the sling becomes caught on inaccessible limbs, branches or foliage and must be forcibly removed.

One solution to the problems discussed hereinabove is provided in U.S. Pat. No. 5,785,146 for ARBOREAL CLIMBING AND SUPPORT METHOD AND APPARATUS, issued Jul. 28, 1998 to Kenneth Michael Palmer. PALMER provides a variant on a traditional sling wherein rings attached to two ends of a web have two different inside diameters. When used in cooperation with a shot or throwbag and a throw line, the PALMER device may be installed in a tree from the ground. Likewise, when no longer needed, the PALMER device may be extracted from a tree by a person on the ground.

Neither this patent nor any other known prior art, taken singly or in any combination, are seen to teach or suggest the novel climbing or rigging blocks of the present invention.

SUMMARY OF THE INVENTION

In accordance with the present invention there is provided climbing or rigging blocks having two portions held together by magnetic attraction. The climbing or rigging blocks may be installed or retrieved from the ground using only a throw line, a throw bag, and a retrieval ball.

It is, therefore, an object of the invention to provide a two-part climbing or rigging block readily installable and retrievable from the ground.

It is another object of the invention to provide a two-part climbing or rigging block installable using only a throw line, throw bag and retrieval ball.

It is an additional object of the invention to provide a two-part climbing or rigging block wherein two individual blocks are joined together into one complete working unit.

It is a further object of the invention to provide a two-part climbing or rigging block that creates a basket hitch and allows for the working load to be applied to one side while the retaining load is applied to the opposite side, thereby splitting the load between the individual blocks.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Arborists and other persons working in trees or other elevated environments must often ascend from the ground to a work site by climbing a rope. In addition, elevated workmen often rely on one or more pulleys and ropes to raise and lower materials. In the case of an arborist topping a tree, the object to be lowered to the ground may be a heavy limb severed from the tree. Other workmen may need to raise an object from the ground to an elevated position. Solutions to such problems generally include securing a pulley at a height above the desired elevated work site.

One technique for securing an elevated pulley is to use a so-called throw bag (e.g., "shot" bag) to place a throw line over an elevated tree limb or other structure. The throw line may then be used to pull a climbing line or other rope over the limb.

Several problems are associated with this simple technique, the worst being friction. When an arborist uses the climbing line to ascend, the line abrades the bark on the limb and may potentially cause serious damage thereto. Simple pads, often referred to as cambium savers, placed over the limb have been used both to lower friction and to protect the cambium layer (bark) of the limb. Such pads are generally difficult to use and the climbing line or other ropes has a tendency to wander off the protective pad as an arborist moves in the tree.

Friction may be further reduced by installing a pulley through which the climbing line passes. By securing the puller to a tree limb, no abrasion of the tree limb occurs due to the rubbing of the climbing line. However, depending on the load on the pulley, a supporting rope may cut into the cambium.

Specialty pulleys, typically called climbing or rigging blocks, have been devised and are well known in the prior art for such climbing and rigging applications. While the terms "pulley" and "block" or "rigging block" are sometimes used interchangeably, there are technical differences. For example, pulleys are typically rated for a static load. However, as an arborist cuts a limb, it may fall a short distance before being caught by a suspending rope, thereby imposing an impact load on the pulley. Rigging blocks are typically constructed and rated to absorb such impact loads.

Figure 1A:
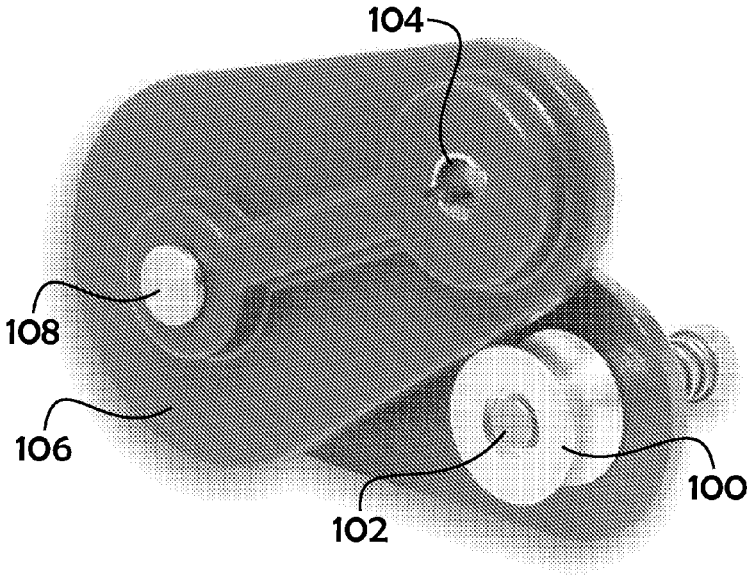
Figure 1a Prior Art
FIGS. 1*a* and 1*b* are pictorial perspective views of rigging blocks of the prior art.
Figure 1B:
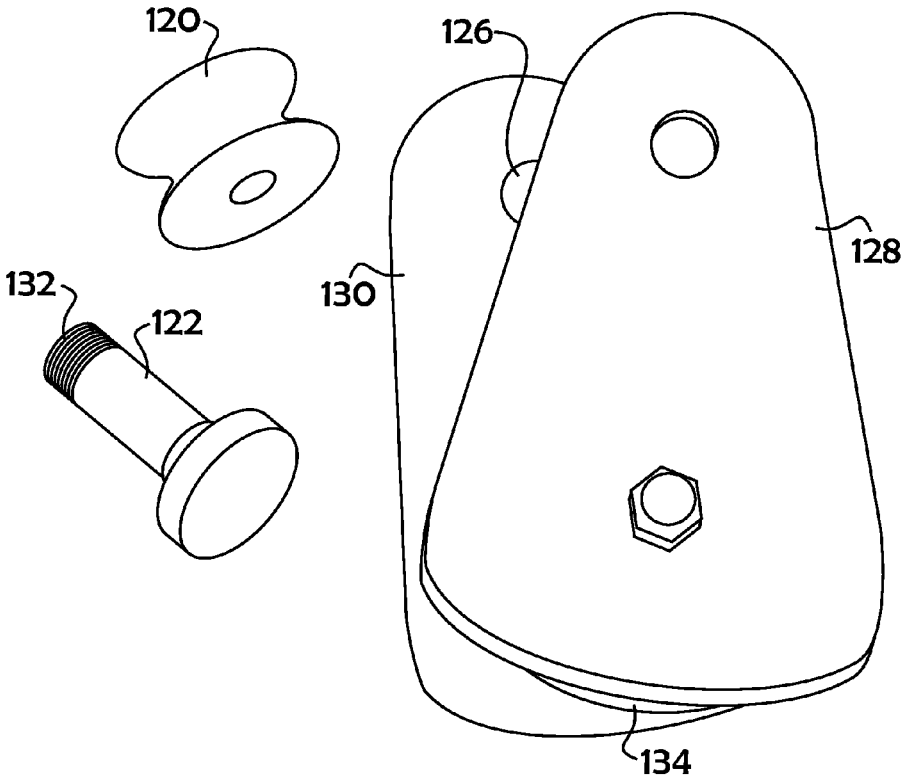
Figure 1b Prior Art

A typical rigging block has a pulley, pin, or other attachment mechanism used for suspending the rigging block, and a lower pulley to support a working rope or line. Often, one side of the rigging block may be opened to allow placement of the rope, cable, or line over the working pulley. For purposes of this disclosure, a block is defined as a solid member, preferably rectangular in shape, as depicted in the preferred embodiment described herein, but other shapes of blocks can be used without departing from the scope of the invention. FIGS. 1*a* and 1*b* show two different typical rigging blocks of the prior art. In FIG. 1*a*, a working pulley 100 has a spring-loaded pin for an axle 102. An end of spring-loaded axle is received in an opening 104 in cheek plate 106 during normal operation. Cheek plate 106 is free to rotate around an upper pin 108 such that a rope or line, not shown, may be placed around the working pulley 100 and/or support pin 108.

In FIG. 1*b* a working pulley 120 is supported by an axle bolt 122 having a threaded end 132. Axle bolt 122 is first passed through cheek plate 128 and then through working pulley 120. Then threads 132 are retained in matching threads 126 in cheek plate 130. Thus, the disassembly of the rigging block allows placing a rope or line over working pulley 120 and/or sheave 134.

By properly designing a climbing or rigging block, installation of the block from the ground may be accomplished.

Figure 2A:
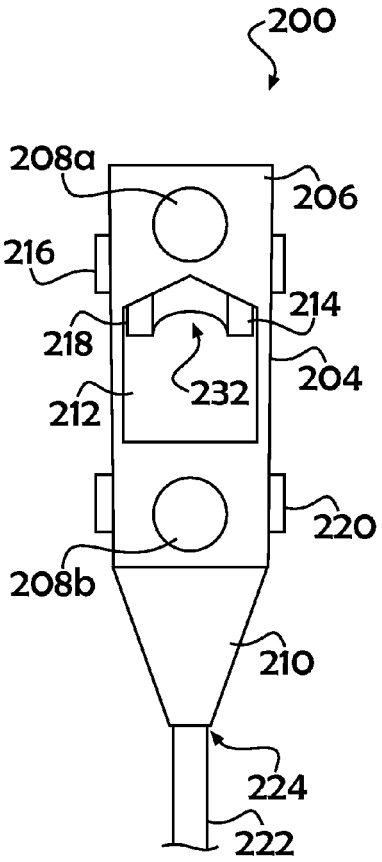
FIGS. 2*a* and 2*b* are rear elevational views of the two portions of the climbing or rigging blocks of the invention.
Figure 2B:
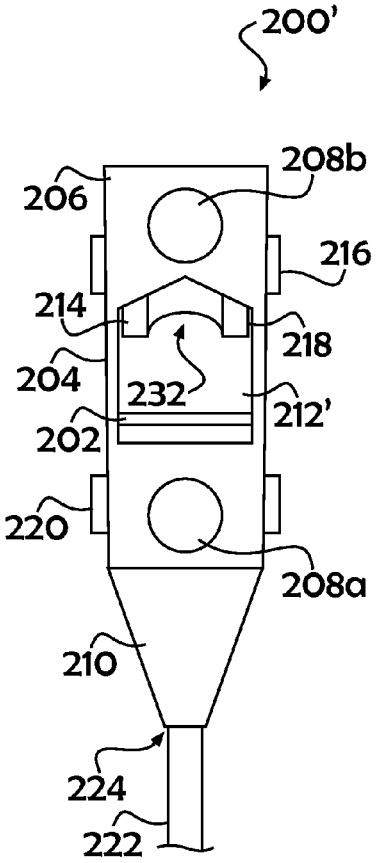

Referring now to FIGS. 2*a* and 2*b*, there are shown rear elevational views of a large opening 212 in block 200 and a small opening 212' of block 200', respectively, in accordance with the present invention. Blocks 200, 200' are substantially identical with the exception of a pin 202 disposed in small opening block 200' and discussed in detail hereinbelow.

Blocks 200, 200' each have a body 204 having a rear surface 206. Body 204 is formed from rectangular tubing, typically anodized aluminum. It will be recognized by those of skill in the art that bodies 204 may be fabricated from other suitable materials including but not limited to steel, titanium, plastic, polymers, carbon fiber composites, and in other shapes. Consequently, the invention is not considered limited to a particular material or to fabrication from a particular shape.

Extruded aluminum tubing is chosen in this embodiment because of its mechanical properties, particularly grain structure running parallel to a major axis of the body 204. The grain structure imparts material strength to blocks 200, 200' useful in handling the working load applied to blocks 200, 200' during normal operation thereof. The solid, one-piece construction of body 204 distributes a working load evenly throughout. Unlike rigging blocks of the prior art having individual cheek plates that swing open, the solid, one piece construction of body 204 and two pairs of magnets, discussed below, also prevent twisting, contorting, or free play of blocks 200, 200' even under heavy loads.

Magnets 208*a*, 208*b* are embedded in rear surface 206 of body 204. Magnets 208*a*, 208*b* are typically rare earth (i.e., Neodymium) permanent magnets chosen for their magnetic strength. It will be recognized that other magnets may be substituted therefor. Typically, magnets 208*a* have a north pole exposed while magnets 208*b* have a south pole exposed. It will further be recognized that the poles could be reversed (i.e., magnets 208*a* could expose a south pole and magnets 208*b* could expose a north pole). The reason underlying the arrangement of magnets 208*a*, 208*b* is discussed in detail hereinbelow.

A polymer nose cone 210 is disposed in an upper portion of body 204. Nose cone 210 is typically formed from 6/6/Nylon having a tensile strength of approximately 10,000 psi. It will be recognized that other suitable materials may exist for forming nose cone 210. Consequently, the invention is not limited to the material chosen for purposes of disclosure. Rather, the invention includes any suitable material.

Nose cone 210 is tapered on all sides resulting in an inverted, truncated pyramid or pyramidal frustum having several functions. First the lower, truncated pyramid section allows blending into the bracket body for smooth passage over surfaces for "kick out" and "kick up." Further, nose cone 210 serves to protect the sling eye, not shown, in sling rope 222 that is attached to mandrel 220 as discussed in detail hereinbelow.

An opening 212, 212' in rear surface 206 reveals a lower portion of a pulley or sheave 214. Sheave 214 is supported on axle 216. Sheave 214 is relatively wide, filling substantially the entire width of body 204, leaving only a minimal gap 218 between the vertical surface of the sheave 214 and the vertical side surface of body 204. The width of sheave 214 allows for better weight distribution of the load over sheave 214 and in transference of the load to axle 216. The sheave width allows minimal traveling or wandering of sheave 214 back and forth over axle 216, thereby reducing free play.

Sheave 214 has several important design features. Sheave 214 has a "rope track" (i.e., rope-receiving contour) 232 that closely matches the size and thickness of the rope or line, not shown. This allows sheave 214 to cradle the rope during use, keeping the rope centered on the sheave 214, not allowing it to wander over the surface or roll out of the sheave 214. For proper operation of the novel climbing or rigging blocks 200, 200', it is important that the rope travel in the true center of the sheave 214. This center traveling facilitates even distribution of the load through the sheave 214, then transferring the load evenly across the axle 216.

Sheave 214 may have a high tensile bushing, not shown. The bushing is typically oil impregnated to provide constant lubrication during the rolling of the bushing over axle 216. In climbing block versions of the novel climbing or rigging blocks 200, 200', a set of high tensile thrust bearings, not shown, may also be installed. These thrust bearings are installed to relieve side load pressure that may be generated under heavy loading.

A mandrel 220 supports a sling rope 222. Sling rope 222 is looped either directly over mandrel 220 or, for large blocks 200, 200', over a sheave 236, shown in FIG. 5, supported by mandrel 220. The preferred slinging material is typically a high tensile strength rope. A rope construction consisting of a solid braid over an inner core has been found satisfactory for making sling rope 222 for use with climbing blocks. For rigging block use, hollow braid material has been found satisfactory. It will be recognized, however, that other suitable materials can be substituted therefor.

An eye 223 is formed in both ends of sling rope 222 by spliced or stitched eye to form a strong, yet low profile hitching point for connecting the sling rope 222 to mandrel 220. Mandrel 220 allows proper fit of the eye 223 while spreading the load over the surface of mandrel 220. Mandrel 220 is machined to proper industry standard bend radii dimensions corresponding to the specific dimensions of sling rope 222. Bend radii dimensions are believed known to those of skill in the art and are not further discussed herein. The mandrel allows proper fit of the eye while spreading the load over the surface of mandrel 220.

Sling rope 222 exits rigging and climbing blocks 200, 200' via an entry point 224 in nose cone 210.

Sling rope 222 is typically surrounded by an anti-abrasion sleeve 234 (FIG. 5) made from Cordura® or a similar material. Abrasion sleeve 234 acts as both a protective cover and a housing for sling rope 222 when engaging the bark or another contact surface, not shown. Friction against the working surface tends to hold sleeve 234 stationary while the sling rope 222 may slide within sleeve 234. This ability of sling rope 222 to slide within sleeve 234 allows the blocks 200, 200' to rotate and move freely under a load while the blocks remain joined. Sleeve 234 is necessary to keep blocks 200, 200' joined, thereby maintaining alignment and not allowing separation of blocks 200, 200' from one another during working loading.

Figure 3A:
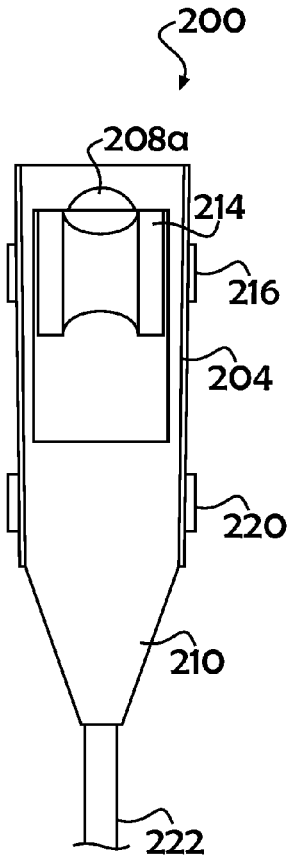
FIGS. 3*a* and 3*b* are front elevational views of the climbing or rigging blocks of FIGS. 2*a* and 2*b*, respectively.
Figure 3B:
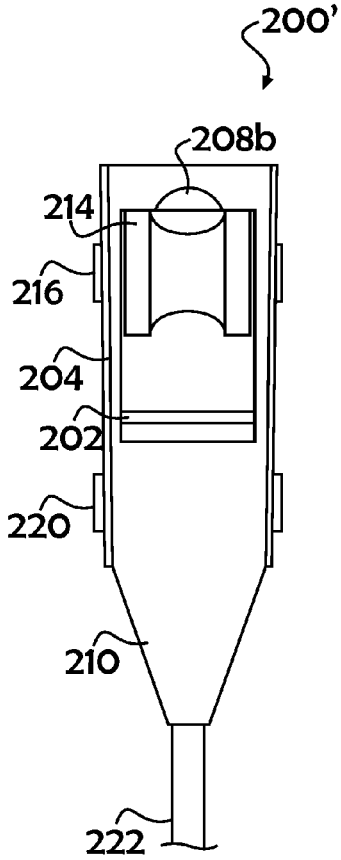

Referring now also to FIGS. 3*a* and 3*b*, there are shown front elevational views of climbing or rigging blocks 200, 200', respectively. Sheaves 214 are more clearly visible in FIGS. 3*a* and 3*b*.

Figure 4A:
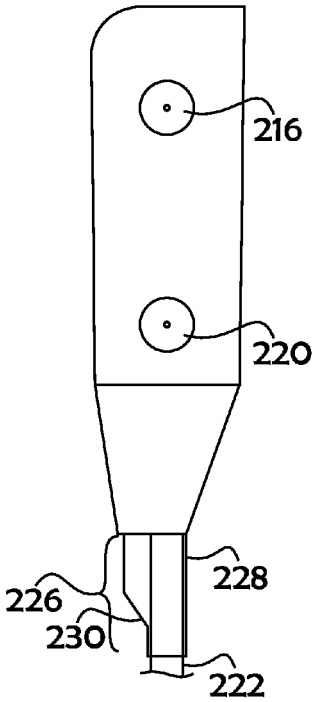
FIG. 4*a* is a left side elevational view of the climbing or rigging block of FIGS. 2*a* and 3*a;*
Figure 4B:
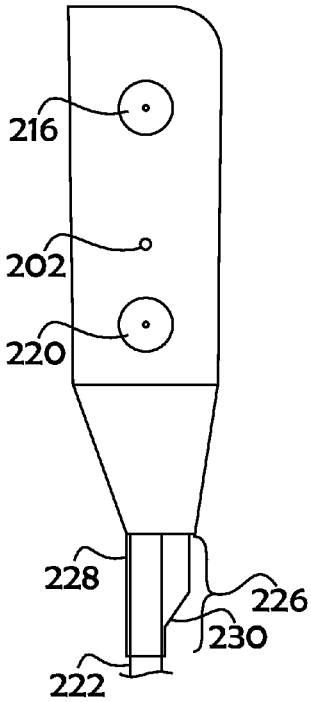
FIG. 4*b* is a right side elevational view of the climbing or rigging block of FIGS. 2*b* and 3*b;*

Referring now to FIGS. 4*a* and 4*b*, there are shown a left side elevational view of block 200 and a right side elevational view of block 200', respectively. An optional heat shrinkable material 228 may cover bottom region 226 of the eye splice and extends slightly beyond the lower end of bottom region 226 of the eye splice.

Figure 5:
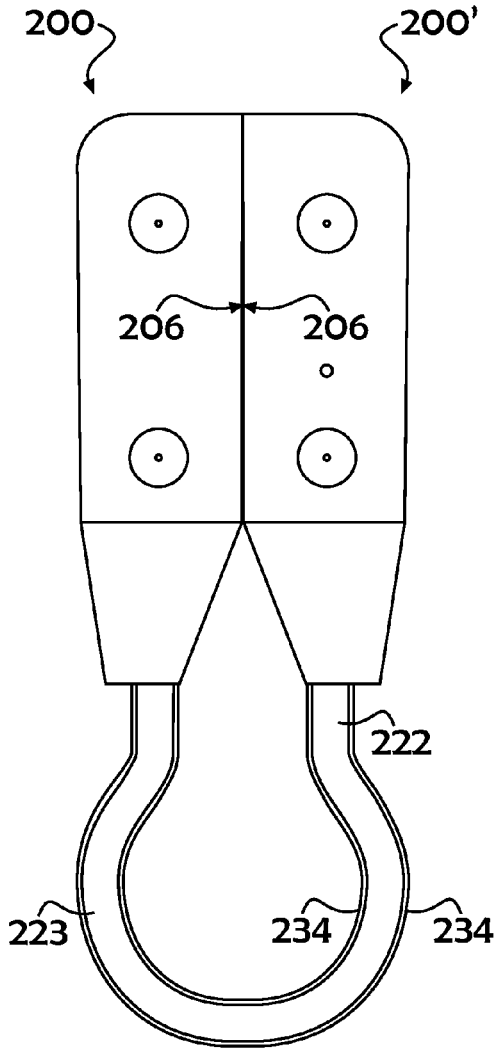
FIG. 5 is a side elevational view of the climbing or rigging blocks of FIGS. 2*a* and 2*b* in a joined, operational configuration.

Referring now also to FIG. 5, there is shown a side elevational view of blocks 200, 200' mated face-to-face in an operational configuration. Sling rope 222 joins block 200 to block 200'.

Optional heat shrinkable material 228 (best seen in FIGS. 4*a* and 4*b*) for use with either spliced or stitched eye, protects the eye region of sling rope 222 from unnecessary wear and damage that could induce failure of the sling. Further, heat shrinkable material 228 provides a predetermined stiffness in the bottom region 226 at the entry point 224 into the nose cone 210, thus creating a lead in taper 230. Lead in taper 230 works in conjunction with the nose cone 210 for retrieving climbing or rigging blocks 200, 200' as described in detail hereinbelow. Further, lead in taper creates a rise in the sling upon entry in the tree crotch, not shown, or while being pulled over a branch, not shown. This rise allows the nose cone 210 to engage the wood or surface of the branch and, consequently to kick upwards and pass over the branch or enter a tree crotch and subsequently kick out for easy retrieval.

Figure 6A:
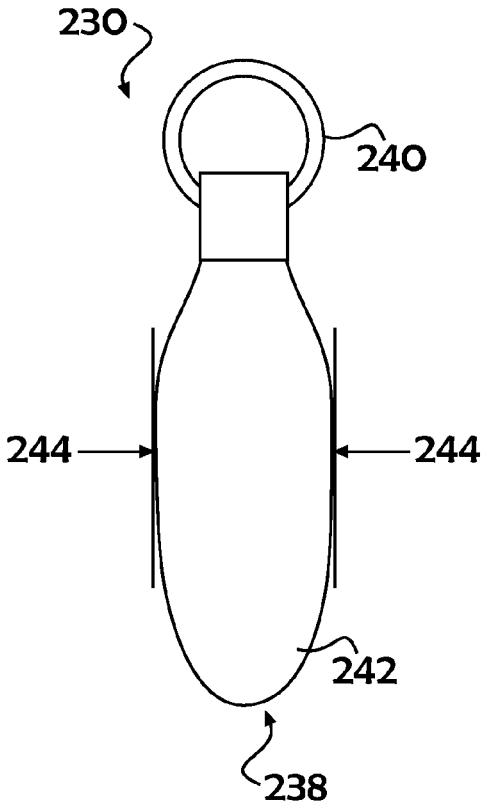
FIGS. 6*a* and 6*b* are schematic, perspective views of two embodiments of an installation and/or retrieval tool.
Figure 6B:
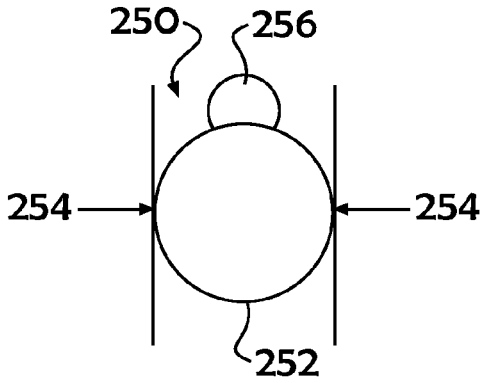

Referring now to FIGS. 6*a* and 6*b*, there are shown top plan views of an installation/retrieval tool, also known as throw bag, and a retrieval ball.

As seen in FIG. 6*a*, installation tool 230 is typically a throwbag having a tapered nose region 238 at a distal end and a body 242 having a diameter 244 selected to readily pass through front opening 212 of large opening block 200; body 242 is too large to pass through front opening 212' of small opening block 200' because pin 202 blocks its passage.

Installation/retrieval tool 230 (e.g., a throw bag) at a proximal end of body 242 has an aperture 240 adapted to receive a throw line or the like.

As shown in FIG. 6*b*, retrieval ball 250 has a body 252 having a diameter 254 selected to allow easy passage of retrieval ball 250 through opening 212 of block 200 but too large to pass through opening 212' of block 200' because pin 202 blocks its passage.

Retrieval ball 250 has a stepped hole 256 through center of body 252. The use of installation/retrieval tool 230 and retrieval ball 250 is discussed in detail hereinbelow.

In operation, the novel climbing or rigging blocks 200, 200' adhere to one another as shown in FIG. 5. The dual sheave design (i.e., the combination of sheaves 214 in each of blocks 200, 200') causes a load on a rope passing thereover to be transferred to the sheaves 214, creating a horizontal side load that forces the two blocks 200, 200' together. This side load magnifies the holding power of the magnets 208.

After installation, the blocks 200, 200' align the sheaves 214 at a calculated spacing from one another. This spacing creates a bend radius significantly larger than the bend radius of industry standard three ton rigging blocks known to those of skill in the art. This oversize bend radius meets or exceeds industry standards set for proper rope bend and wear. This bend radius is important for ease of use of the blocks 200, 200' and for rope life and wear.

The novel construction of climbing or rigging blocks 200, 200' allows the installation and subsequent removal of the blocks from the ground, a great convenience to an arborist or other such workman.

To install climbing or rigging blocks 200, 200', the following procedure has been found useful. First, a throw line, not shown, is lobbed over a desired tree limb or other structure, not shown, from which the climbing or rigging blocks 200, 200' are to be suspended. This is typically accomplished using a throw or shot bag 230 (FIG. 6*a*). Throw lines, throw bags, and retrieval ball form no part of the invention. They are considered to be well known by those of skill in the art. This technique is believed to be well known to arborists and the like.

The throw bag 230 is then lowered and untied from the end of the throw line. This end of the throw line is hereinafter referred to as the "bag end." The opposite end of the throw line is hereinafter referred to as the "feed end." The bag end of the throw line is inserted through opening 212' from the rear surface 206 of block 200' (i.e., the block having the smaller opening created by pin 202) and passed out through rear surface of block 200'.

An installation tool 230 as shown in FIG. 6*a* is then attached to the bag end of the throw line using an appropriate knot or hitch. Suitable knots and/or hitches are known to those of skill in the art and are not further described herein.

The supply end of the throw line is then passed through block 200 (i.e., the block without pin 202) also from front face 206. Once the blocks 200, 200' are so configured with respect to the throw line, the supply end of the throw line is pulled to raise blocks 200, 200' connected by sling rope 222 into the air towards the limb or other support structure over which the supply line has previously been lobbed.

Continued tension on the feed end of the throw line pulls block 200' over the limb or support. Once block 200' has been pulled over the top of the limb or support, both blocks 200 and 200' are supported by sling rope 222. As they approach one another, blocks 200, 200' are oriented such that magnets 208 attract the two blocks 200, 200' which magnetically aligns and locks to one another into a single unit, as seen in FIG. 5.

The installation tool is then lowered to the ground and disconnected. The eye of a climbing or rigging line, not shown, may then be connected to the throw line and pulled upwards through both blocks 200, 200' over respective sheaves 214 (FIGS. 2*a*, 2*b*). As the climbing or rigging line is pulled through first small opening block 200' and then large opening block 200, the blocks 200', 200, if not already aligned and locked to one another, are drawn together, thereby ensuring alignment.

When work utilizing the novel climbing or rigging blocks 200, 200' is complete, the blocks may be retrieved from the ground. This is accomplished by attaching retrieval ball 250 and the end of a throw line to the end of the climbing or rigging line closest to block 200 (i.e., the block with the larger opening).

The opposite end of the climbing or rigging line is pulled, thereby drawing the retrieval ball 250 and throw line over sheave 214 of block 200'. However, when retrieval ball 250 encounters pin 202 of block 200', further progress of retrieval ball 250 is prevented. It should be noted that the throw line continues to pass through block 200.

Additional pulling on the climbing or rigging line pulls block 200' away from block 200 by overcoming the magnetic attraction of magnets 208. Once separated, block 200'begins descending as the climbing or rigging line is pulled. As block 200' descends, block 200 ascends, pulled by sling rope 222.

Eventually, block 200 and the throw line are pulled up and over the limb or other support. Once block 200 clears the limb or support, the throw line is still in place over the limb or support.

Tension on the throw line keeps blocks 200, 200' and sling rope 222 from falling. As throw line is let out, the descent is controlled until blocks 200, 200' and sling rope 222 are safely on the ground.

The install tool 230 is again attached (if it has been unattached since the installation process). The opposite end of the throw line is pulled, thereby raising the installation tool 230. Eventually the installation tool 230 passes through the large opening in block 200. As installation tool 230 cannot freely pass through the opening in block 200', the pressure of installation tool 230 against block 200' results in separating blocks 200 and 200' from one another.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A two-part, magnetically-secured climbing or rigging block, comprising:

a) a first block having a first body comprising at least a rear surface having a first central opening disposed therein, a left side surface perpendicular to the rear surface and a right side surface substantially parallel to said left side surface;

b) a sheave disposed proximate a lower end of said first body, said sheave being rotatably connected to an axle, said axle being disposed between said right side surface and said left side surface and substantially perpendicular thereto;

c) a first magnet having a predetermined pole disposed flush with said rear surface and proximate an upper end of said first body;

d) a second magnet having a pole opposite said predetermined pole of said first magnet flush with said rear surface and disposed proximate a lower end of first body;

e) a first nose cone having a first portion and a second portion adjacent thereto, said nose cone having a major axis, said first portion being disposed within said first body at a upper end thereof, said second portion extending beyond an upper end of said first body with a portion of said second portion facing away from said first body;

f) a second block portion having a second body comprising at least a second rear surface having a second central opening disposed therein, said second central opening being smaller than said first central opening, a second left side surface perpendicular to the second rear surface and a second right side surface substantially parallel to said second left side surface;

g) a second sheave disposed proximate a lower end of said second body, said second sheave being rotatably connected to a second axle, said second axle being disposed between said second right side surface and said second left side surface and substantially perpendicular thereto;

h) a third magnet having a pole opposite said predetermined polarity of said first magnet flush with said second rear surface and proximate an upper end of said second body;

i) a fourth magnet having a pole opposite said predetermined pole of said third magnet flush with said second rear surface and disposed proximate a lower end of said second body;

j) a second nose cone having a third portion and a fourth portion adjacent thereto, said nose cone having a major axis, said third portion being disposed within said second body at an upper end thereof, said fourth portion extending beyond an upper end of said second body with a portion of said fourth portion facing away from said second body; and k) a sling rope having a first end permanently attached to at least one of said first body and through said first nose cone and a second end permanently attached to at least one of said second body and through said second nose cone.

2. The two-part, magnetically-secured climbing or rigging block as recited in claim 1, wherein said body is formed from aluminum.

3. The two-part, magnetically-secured climbing or rigging block as recited in claim 1, wherein said magnets comprise Neodymium rare earth magnets.

4. The two-part, magnetically-secured climbing or rigging block as recited in claim 1 further comprising an outer sleeve slidably attached to said sling rope, said sling rope being free to move within said sleeve.

5. The two-part, magnetically-secured climbing or rigging block as recited in claim 1, wherein said first and second block portions each has a substantially rectangular elongated shape.

6. The two-part, magnetically-secured climbing or rigging block as recited in claim 5, wherein said second and fourth portions of said first and second nose cones have a truncated pyramid shape and wherein said second and fourth portions of said first and second nose cones each has a truncated vertex facing away from said second body.

7. A method of installing and retrieving a two-part, magnetically-secured climbing or rigging block, the steps comprising:

a) lobbing a throw line having a first end and a second end over a desired tree limb or other structure;

b) lowering a throw bag and untying said throw bag from the first end of said throw line;

c) attaching an installation tool to the first end of said throw line;

d) attaching the first end of said throw line to a first block comprising a first magnet;

e) attaching the second end of said throw line to a second block comprising a second magnet; and f) tensioning said throw line at a point intermediate said first and second ends thereof to orient said first and second blocks to magnetically align said magnets therein, forming a single unit.

* * * * *